US005797551A

United States Patent [19]

Wirz et al.

[11] Patent Number: 5,797,551

[45] Date of Patent: *Aug. 25, 1998

[54] METHODS AND APPARATUS FOR THE WINDING OF FILAMENTS

[75] Inventors: Armin Wirz, Ossingen; Peter Busenhart, Wiesendangen, both of Switzerland

[73] Assignee: Maschinenfabrik Rieter AG, Winterthur, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 653,699

[22] Filed: May 23, 1996

Related U.S. Application Data

[63] Continuation of Ser. No. 151,888, Nov. 15, 1993, Pat. No. 5,533,686.

[51] Int. Cl.[6] ..... B65H 54/00; B65H 51/30

[52] U.S. Cl. ..... 242/18; 242/18 R; 242/418

[58] Field of Search ..... 242/18 R, 18 A, 242/18 DD, 36, 418, 470, 541.1, 541.4, 541.5, 541.6, 542.1, 534, 547

[56] References Cited

U.S. PATENT DOCUMENTS

| | | | |
|---|---|---|---|
| 3,288,383 | 11/1966 | Muller | 242/18 R |
| 3,329,360 | 7/1967 | Schippers | 242/18 DD |
| 3,871,598 | 3/1975 | Kataoka | 242/541.1 X |
| 4,069,985 | 1/1978 | Lohest et al. | 242/18 DD |
| 4,106,710 | 8/1978 | Schippers et al. | 242/18 R |
| 4,120,462 | 10/1978 | Raasch et al. | 242/541.4 X |
| 4,548,366 | 10/1985 | Wirz et al. . | |
| 4,677,387 | 6/1987 | Mutter et al. | 242/18 DD |
| 4,765,552 | 8/1988 | Sugioka et al. . | |
| 4,986,483 | 1/1991 | Ryu et al. . | |
| 5,004,170 | 4/1991 | Graf et al. . | |
| 5,033,685 | 7/1991 | Busenhart et al. . | |
| 5,318,232 | 6/1994 | Busenhart et al. . | |
| 5,533,686 | 7/1996 | Wirz et al. | 242/18 R |

FOREIGN PATENT DOCUMENTS

| | | |
|---|---|---|
| 22 00 627 | 1/1973 | Germany . |
| 35 13 796 | 12/1985 | Germany . |
| 36 30 668 | 4/1987 | Germany . |
| 37 18 616 | 12/1987 | Germany . |
| 42 11 985 | 10/1992 | Germany . |
| 41 26 392 | 12/1992 | Germany . |

OTHER PUBLICATIONS

Article: Maschinenelemente, G. Niemann, H. Winter, vol. 3, pp. 190, 200, 201: Springer–Verlag (1983).

Article: Vorlesungenüber Maschinenelemente, M. Ten Bosch, pp. 300–304; Berlin (1940).

Brochure "Riemat AG–09", Sep. 1992, Rieter Chemical Fiber Systems.

*Primary Examiner*—Michael Mansen

*Attorney, Agent, or Firm*—Dority & Manning

[57] ABSTRACT

In a filament spinning and packaging system, a winder is employed to draw filaments from the filament processing operation at a threadline tension level suited to the processing operation. The winder winds the thread into large cylindrical packages. It includes a control system which may be set to control the tension of the thread entering the outer layer of the package to a level suited to the building of a good thread package, while maintaining a different upstream threadline tension suited to the filament processing operation.

23 Claims, 8 Drawing Sheets

FORCE TRANSFER THEORY DIAGRAM

METHODS AND APPARATUS FOR THE WINDING OF FILAMENTS

This application is a continuation of application Ser. No. 08/151,888, filed Nov. 15, 1993 now U.S. Pat. No. 5,533,686.

RELATED INVENTION

The present invention relates to developments in the filament winding system disclosed in U.S. Pat. No. 4,548,366 (EP 182 389).

BACKGROUND OF THE INVENTION

STATE OF THE ART

U.S. Pat. No. 4,548,366 discloses a winding arrangement in which a contact roller (in contact with the outer surface of a filament package) is driven to apply a controlled force to the package surface while the speed of rotation of the roller is regulated by regulating the speed of rotation of the package.

U.S. Pat. No. 4,765,552 discloses limitation of the controlled force to a range given by a motor torque for the contact roller between 0 and 1.5 Newton-centimeter per filament package. This latter specification is unclear in its explanation of the quoted range but the justification appears to relate either to avoidance of "small slips" which cause yarn quality variations or to avoidance of speed differentials giving tube damage at first contact of the roller with a bare bobbin tube.

German Document 35 13 796 proposes a drive system in which the package is driven on its circumference by a friction drive roll while thread from a traverse motion is laid on the package by an additional contact roll. The contact roll is driven to give a slight excess speed of the contact roll relative to the package. This is designated to enable control of thread tension.

U.S. Pat. No. 4,986,483 describes in some detail the problems discussed below (in the section "Problem Addressed") and proposes a combination of a drive system of the type discussed above with a special traverse cam device. The drive system is intended to be operated in a manner such as to avoid the transmission of circumferential force between the contact roller and the package for minimizing the generation of slip between the contact roller and the package.

German Document 41 26 392 describes a system to apply feedback control to the generation of the motor torque for the contact roller. The generated motor torque is related directly to the circumferential force transferred between the roller and the package.

The stated purpose of the arrangement according to German Document 41 26 392 is the achievement of control over the force transmitted at the interface between the roller and the package. By this means, slip at the interface is to be avoided. According to the German specification, slip is especially likely to occur when contact pressure is low and the system is subject to variations which risk an approach to or exceeding of the slip limit. Another stated purpose is to avoid occurrence of inhomogeneities over the period of winding a package.

Problem Addressed

The present invention addresses the problem of building a cylindrical cross-wound package of filament under conditions such that the threadline tension immediately upstream from the winder is at a level which, if the same threadline tension persisted through to the package, would cause package build problems before the desired package dimensions are achieved. In order to explain this statement further, a brief explanation of package build problems as related to thread tension, will be given.

The basic problem involved in building a cross-wound package arises from the traverse motion needed to move the thread in the axial direction to generate the winding angle. It is an inevitable characteristic of this motion that the thread travels relatively slowly in the (end) reversal regions as compared with the central package region. Many improvements have been proposed in the mechanisms generating the traverse motion in order to mitigate this problem and they have had considerable success. Their effect is not, however, to eliminate the problem but only to delay its appearance. Thus, by means of improvements made in traverse mechanisms, we have been able to build steadily larger packages (i.e. of larger diameter) over the years.

It follows from the relatively slow axial motion of the thread in the reversal regions that more thread material is deposited in the end regions of the package than in the central region thereof. This has two effects; namely:

1) sooner or later the outer surface of the package is no longer cylindrical—it takes on a "saddle-like" appearance with raised "shoulders" at its edges (see FIGS. 8 and 12).
2) the density (and therefore the hardness) of the package in the edge regions is higher than the density of the package in its central region.

The contact roller has long been used as a device for mitigating the first effect. By means of the contact pressure applied by this roller, it is possible to flatten the shoulders to some extent. The flattening effect is limited by outward bulging of package ends (i.e., the package side walls) due to the applied pressure (see FIG. 13). Therefore, as previously indicated, sooner or later (as package diameter increases) shoulders will appear and when they reach a certain size they lead to unstable thread layers within the package and hence to problems in subsequent unwinding for further processing.

The second effect works together with the threadline tension to exaggerate the first effect. Because package density is lower in the central region, the package is more easily compressible in its central region than at its ends. The tension of the thread as it is wound into the package exerts a compressing effect on the underlying thread layers (and on the tube which forms the core of the package). The greater the thread tension, therefore, the greater the compressing effect and the more the central package region is squeezed in relative to the end regions.

It is not necessary to provide any solution for this latter problem within the winder itself if threadline tension can be influenced upstream from the winder. Modern filament production processes are, however, tending in the direction of simplifying upstream processing, thereby gradually eliminating possibilities for determining thread tension as the thread enters the winder. Furthermore, modern filament processing techniques are tending to generate steadily higher threadline tensions. For economic reasons, there is a demand for steadily larger packages. The winder manufacturer is therefore faced nowadays with the problem of converting "given" threadline conditions at the winder inlet into conditions which enable satisfactory package build (as regards package form) up to diameters of at least 500 mm. However, the formation of a saddle shape and axial bulging, as described above, limits the size of packages which can be built under given winding conditions.

For reasons outlined above, in most cases the problems arise from high threadline tensions at the winder inlet working through to high tension at the point of laydown in the package. In a relatively small, but important, class of cases, however, the opposite problem arises. The technology of the process in those cases is such that the thread tends to relax as it is wound. In such cases, it is necessary to increase thread tension in order to ensure a desired package build.

SUMMARY OF THE INVENTION

The present invention is based upon a realization that by promoting the generation of slippage at an interface between a package and contact roller, the rate at which the shape of the package deviates from a cylindrical shape can be reduced, thereby enabling larger packages to be built under given winding conditions. By changing the amount of promoted slippage during the building of test packages, the optimum amount of slippage can be learned for a given thread type.

The present invention provides a method of influencing winding tension (i.e., thread tension at the zone of laydown in the package) in relation to delivery tension in the threadline upstream from the winder (i.e., at the winder inlet) by means of a system as described in the introduction hereto. According to the method now proposed the contact roller is driven so as to apply a net circumferential force (either driving or braking) to the surface of the package while the thread to be wound is delivered from the contact roller to the package surface after passing around a portion of the circumference of the contact roller with a substantially predetermined angle of wrap thereon. The rolling contact generated between the contact roller and the package is such that a generally controlled relationship is maintained between the rotation of the roller and the rotation of the package, but such as to permit a small speed differential between the surface of the package and the surface of the roller thereby giving an effective change of thread tension between the threadline tension upstream of the roller and downstream therefrom.

The arrangement is preferably such that the speed differential is varied during the period of package build. In the event of a reduction in thread tension created by means of a speed differential, the degree of reduction may be reduced as package build proceeds. In the event of an increase in thread tension created by means of a speed differential, the degree of increase may be increased as package build proceeds.

BRIEF DESCRIPTION OF THE DRAWINGS

By way of example, embodiments of the invention will now be described by reference to the accompanying drawings, in which.

DETAILED DESCRIPTION OF PREFERRED EMBODIMENTS OF THE INVENTION

As will be described hereinafter in detail, for given winding conditions the present invention enables larger diameter packages to be built by reducing the rate of formation of the saddle shape (FIG. 12) and/or axial bulging (FIG. 13) on the package. This is achieved by building test packages, inspecting their shape for deviations from a cylindrical shape, and then changing the thread tension at laydown in the package in order to reduce the rate of formation of such deviation in a subsequent test package. During the package formation, slippage at the interface between a contact roller and the package is promoted, and the amount of slippage is changed between the forming of respective test packages in order to vary the thread tension at laydown in the package. The amount of slippage can be changed by changing the pressing force generating the contact pressure between the contact roller and package and/or changing the circumferential force transmitted between the contact roller and package.

Figure 1:
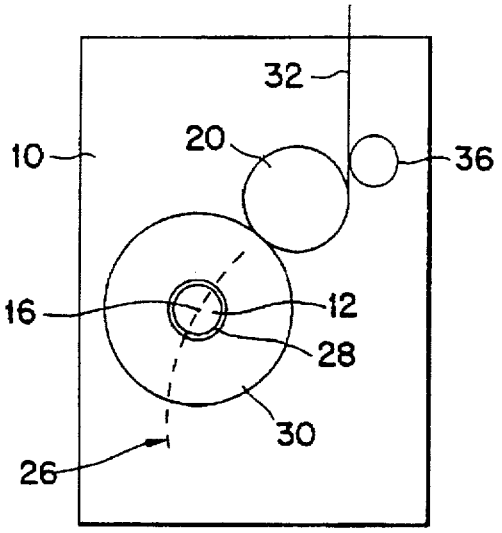
Fig. 1 PRIOR ART
FIGS. 1 and 2 are copies of Figures taken from U.S. Pat. No. 4,548,366 to illustrate the prior art and the basic features of a filament winder suitable use in accordance with this invention.
Figure 2:
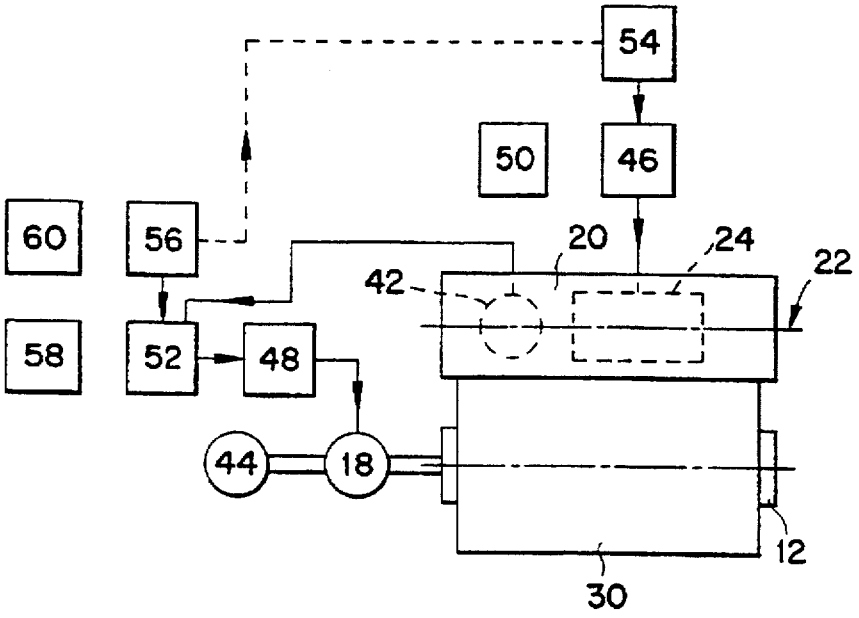
Fig. 2 PRIOR ART

The machine shown diagrammatically in FIGS. 1 and 2 is a high-speed winder for thread of synthetic plastics filament. For ease of explanation and illustration, the machine is described with reference to a single threadline only. However, the machine may be adapted to handle a plurality of threadlines simultaneously. The elements shown in FIGS. 1 and 2 are illustrated in the conditions they adopt during a thread winding operation because the present invention is particularly concerned with the machine in that condition. Other machine conditions will be referred to only briefly in the course of this description.

Also, for ease of description, the example chosen to illustrate the invention has a single chuck. The invention is equally applicable to automatic winding machines having more than one chuck, e.g. a pair of chucks which can be brought alternately into a winding position. For completeness, this type of machine will be described with reference to FIG. 9 but since the invention itself is concerned primarily with an individual winding operation it can be explained adequately by reference to the single chuck machine shown in FIGS. 1 and 2.

The machine comprises a frame and housing structure ("frame") 10 on which the other parts are mounted. A chuck 12 is mounted to extend cantilever-fashion from the front face of the frame 10. This chuck 12 is rotatable about its longitudinal axis 16 by means of an asynchronous electric motor 18 (FIG. 2).

Chuck 12 is movable by means (not shown) towards and away from a contact roll 20 which is mounted in the frame 10 for rotation about its roll axis 22 (FIG. 2). Rotation of roll 20 about this axis 22 is produced by an asynchronous electric motor 24 which is designed with an external rotor enclosing a stator fixed against rotation relative to the frame.

Movement of chuck 12 towards and away from roll 20 involves movement of axis 16 along a curved path 26 (FIG. 1). At one end of the path 26, furthest spaced from the roll 20, chuck 12 has a rest position in which a package 30 formed during a winding operation can be removed from the chuck and replaced by an empty tube 28 upon which a new package can be built in the next winding operation.

At the other end of the path 26, closest to contact roll 20, the chuck enters a winding position in which a thread 32 delivered to the winder can be wound on the tube 28 to form the package 30. As illustrated in FIG. 1, the winding machine is of the well-known "print friction" type in which a thread 32 passes around a portion of the circumference of the contact roll 20 before being transferred from that roll to the package 30. During winding of a package 30, the thread is reciprocated longitudinally of the chuck axis 16 by means of a conventional traverse mechanism 36 provided upstream (considered in the direction of movement of the thread) from the contact roll 20.

A control means for controlling the winding speed is shown in FIG. 2, in the condition it adopts when contact has been established between the contact roll 20 and the package 30 so that driving force can be transmitted between the contact roll and the package. This control system comprises a tacho generator 42 coupled to the rotor or drive shaft of the contact roll 20, a tacho generator 44 coupled to the drive shaft of the chuck 12, an invertor 46 for feeding the roll motor 24, an invertor 48 for feeding the chuck motor 18, a regulator 50 for regulating the output of the invertor 46, a regulator 52 for regulating the output of the invertor 48, a setting device 54 operable to set the output of the invertor 46, a setting device 56 for providing a setting value to the regulator 52, an auxiliary setting device 58 and a timer 60.

In the circuit configuration shown in FIG. 2, regulator 52 is receiving the output of its setting device 56 and also the output of the tacho-generator 42. Regulator 52 compares the inputs from the setting device 56 and generator 42 and provides an output to the invertor 48 in dependence upon this comparison. Inverter 48 supplies a corresponding input to the motor 18 to control the speed of the latter.

In the prior art patent (U.S. Pat. No. 4,548,366) it was assumed for purposes of description that there is no slippage at the region of contact between the windings 30 and the roll 20. As far as this assumption remains true, the tangential speed of the windings in the contact zone will be equal to the tangential speed of the contact roll 20. Since the diameter of the roll 20 is constant throughout the winding operation, this tangential speed is represented directly by the output of the tacho generator 42. Regulator 52 acts via invertor 48 to hold the output from generator 42 constant at a value set by the setting device 56. In other words, regulator 52 effectively holds the speed of rotation of the contact roll 20 constant throughout the period of the winding operation for which the circuit configuration shown in FIG. 2 is effective. Since the diameter of the package is steadily increasing throughout the winding operation, and the assumption has been made that there is no slippage in the contact region between the package and the contact roll, a constant circumferential speed of the package in the contact region will necessitate a gradual reduction in the rate of revolutions of motor 18 and chuck 12 from the beginning to the end of the winding operation.

In the circuit configuration described immediately above, tacho-generator 44, device 58 and timer 60 play no direct part in the control operation. These elements are provided primarily for use during a package changeover when contact has to be made between a new tube 28 and/or package 30 and contact roll 20. Suitable arrangements for this purpose are described in U.S. Pat. No. 4,548,366, but those arrangements are not essential to the present invention and they will not be described herein.

Contact roll 20 is influenced on one hand by reason of its contact with the package 30 and on the other hand by reason of its connection with motor 24. During a winding operation, motor 24 receives an input from its own invertor 46. This input is determined directly by the setting device 54 which for this purpose is connected directly to the invertor 46. The effect of variation in the setting of device 54 has been disclosed broadly in U.S. Pat. No. 4,548,366 (especially in the description of FIG. 6 thereof) and this effect will be discussed further below after additional explanation of the goals to be intended to be achieved by means of the present invention.

A degree of confusion has entered into some of the prior art specifications discussed in the introduction to the present description because those specifications attempt to derive a direct relationship between the operation of a device of the type illustrated in FIGS. 1 and 2 and a concept (more or less closely defined) of "yarn quality". The invention to be described in the following paragraphs will have an indirect influence on yarn quality and this influence will be explained further towards the end of the description. However, it is not the primary purpose of this invention to improve "yarn quality" and the invention does not set itself the aim of ensuring yarn quality any better than that obtainable from other (including conventional) winding processes. For general commercial purposes, that quality has proved perfectly adequate.

The present invention concentrates instead upon the conditions needed to ensure a good package build. That is, the winding conditions which lead to a good package structure. The indirect effects upon yarn quality will be achieved insofar as yarn defects generated by package structural faults are eliminated by means of the present invention.

U.S. Pat. No. 4,548,366 describes a method of influencing the circumferential force generated at the interface between a contact roller and a package in a system as illustrated in FIGS. 1 and 2. The subsequent introduction of "yarn quality" as a central goal for the operation of such a system has led to misjudgment of the role of slip in the contact region between the roller and the package.

U.S. Pat. No. 4,548,366 assumes the absence of slippage in this contact region. This assumption was made for the purpose of explanation of the operation of the contact roller as a measuring device for the circumferential (tangential) speed of the package surface. The assumption is not raised in U.S. Pat. No. 4,548,366 to the status of an essential feature of the system and subsequent investigations have shown that it is in fact impossible to avoid generation of slip in the contact region if the goal of adjustable (i.e. variable) setting of circumferential force is to be achieved. This conclusion is consistent with theoretical studies of motion transmission systems involving transmission of drive by means of rolling surfaces, see e.g. the textbook "Maschinenelemente" by G. Niemenn and H. Winter, Springer Verlag; Volume 3, Pages 190 to 201. These studies show that it is impossible to transmit circumferential force at interfaces of the type involved in those studies without generating a degree of slippage at the interface. The relevant studies are not transferable directly to the interface between a contact roller and a filament package, but the general conclusions drawn from those studies will be equally applicable to both cases.

As indicated in the introduction to this specification (see section entitled "Problem addressed") the present invention is directed primarily to the goal of influencing thread tension downstream from the contact roller (i.e. in the newly forming outermost layer of the thread package) relative to the threadline tension upstream from the contact roller. The latter tension, which is beyond the control of this invention, is determined by the technology of the filament spinning process and by the design of the installation upstream from the winder. It is technically feasible but economically highly undesirable to tailor the winder design specifically to a given spinning process. In practical terms, therefore, a filament winder must be designed to build an acceptable package from filaments exhibiting an infeed tension (i.e. threadline tension at the entry into the winder) variable within a significant range (e.g. from 0.1 to 0.3 gm/dtex), while an ideal package build is usually obtained only with thread tension at the laydown point in the range 0.08 to 0.15 gm/dtex.

In accordance with the present invention, the desired adjustment in thread tension is effected by generating circumferential force in the contact region between the contact roller and the package such as to create a controlled difference in velocity of the surface of the roller relative to the surface of the package. In other words, this invention seeks to influence thread tension at the package circumference relative to thread tension in the threadline upstream from the roller by generating controlled slippage at the interface between the contact roller and the surface layer of the package. This contrasts with the prior art in which attempts have been made to eliminate such slippage, or in which the slippage has been assumed to be absent.

For the sake of completeness it is mentioned at this point that the slippage generated in accordance with this invention will have certain minor degrading effect upon the quality of the yarn wound into the package. However, this minor degrading of yarn quality has to be seen against the following background:

Filament package winding has practically always involved contact between a roller and the newly forming package and there has almost always been a degree of slippage in this contact region. In the case of the previously conventional friction drive systems, many of which are still in practical operation, slippage in the contact region has reached very considerable levels. The effects of such slippage, within tolerable limits, have long been incorporated into specifications of yarn properties of commercially acceptable filament yarns.

The present invention represents a step forward insofar as the level of slippage is controlled so that the effects are substantially predictable in a given winding operation. This predictability is not theoretical but empirical. That is, the results of initial tests performed with given winding conditions can be consistently reproduced.

Under modern production conditions for partially oriented (POY) and fully drawn yarns (FDY) yarn quality has already been substantially predetermined in the threadline upstream from the winder and any effects on yarn quality in the contact region within the winder will be small in comparison with effects achievable in the critical regions upstream from the winder. Insofar as the present invention enables the higher winding speeds needed for POY and FDY processes small quality degradations at the contact regions in the winder will be more than offset by quality gains arising from the ability to use modern processing techniques.

As will be explained subsequently in the final part of this description dealing with yarn quality aspects, quality degradation effects in the contact region represent only some of the degradation effects arising in the winding machine taken as a whole, and disadvantages arising from slippage in the contact region can be more than offset by advantages arising from the newly proposed method of operation of the complete winder.

By means of controlled slippage in the contact region such that the contact roller is traveling faster in that region than the surface layer of the package ("roller advance"), the yarn can be caused to relax as it is transferred from the roller to the package. This relaxation will correspond with a reduction in the elastic elongation of the yarn in the surface layer of the package relative to the corresponding elongation of the yarn on the surface of the contact roller. This is the mode of operation most generally applicable in modern processing techniques which inherently tend towards relatively high threadline tensions at the entrance to the filament winder.

However, in contrast to the teachings contained in U.S. Pat. No. 4,765,552, this invention is not limited to the roller advance system providing relaxation of yarn tension for winding. In a relatively small, but commercially significant, range of spinning processes, threadline tension at the entrance to the winder is too low to enable successful package build. This is especially true in spinning of filament at low speed (for example below 1000 m/min.). Such processes are used for spinning yarn which is subsequently passed to a separate drawing stage (for example a drawtwister). Some industrial yarns and tire cords are processed in this way. Low speed processes are also used for production of high modulus filaments, for example so-called aramids. An increase in tension between the infeed to the winder and the point of laydown in the package can also be advantageous in high speed spinning of relatively thick filaments. In such cases the present invention is used to ensure a higher circumferential speed of the package relative to the circumferential speed of the contact roller ("package advance") so that the yarn is actually additionally stretched as it is transferred from the roller to the outer package layer. That is, the elastic elongation of the yarn in the surface layer of the package is higher than the corresponding elongation of the yarn on the surface of the contact roller.

It is of great importance to the control of the winding operation in accordance with the present invention, that the level of slippage generated at the roller/package interface is controlled, i.e. is maintained within an acceptably narrow range of values (tolerance range) throughout the winding operation. This is because the contact roller in accordance with this invention still represents an essential element of the measuring means by which the circumferential speed of the package itself is to be controlled. Accordingly, if unpredictable levels of slippage were to arise at the interface region, the feedback signal generated by means of the contact roller would have no significance for the package and it would then be impossible to maintain controlled winding conditions giving uniform and reproducible yarn characteristics. However, for the purposes of a given winding operation, it is not necessary to know the level of slippage which will be generated. The circumferential speed of the contact roller is in any event held at a predetermined level by means of the feed back loop described generally with reference to FIGS. 1 and 2 and in further detail in U.S. Pat. No. 4,548,366. The system can then be operated in preliminary tests under the given winding conditions to determine the setting for the contact roller drive giving optimum package build under the given winding and spinning conditions, including filament type and titer, spin finish, winding contact pressure, etc. In other words, for those given conditions, the system is fully specified by the set value for the circumferential speed of the contact roller and the setting for the drive motor of that roller without precise knowledge of the slippage level. The relevant characteristic for evaluating the performance of the system is not in any event the slippage level generated at the roller/package interface but the package build which can be achieved by exploitation of a speed differential at that interface.

It is an important characteristic of a system in accordance with this invention that no slippage arises between the yarn and the surface of the contact roller upstream from the roller/package interface. This is important because the surface of the contact roller acts as an element in the arrangement for transmitting the traverse motion to the roller/package interface. In other words, the surface of the contact roller acts as a member in the arrangement for ensuring that the motion of a "yarn element" (i.e. a very short length of yarn) at the moment at which it is laid on the package surface is substantially determined by the motion imparted to that "yarn element" at the instant at which it was in direct co-operation with the traverse device. If slippage were to arise between the yarn and the surface of the contact roller upstream from the roller/package interface, then control would be lost over the thread tension at the point of the laying of the thread onto the package surface.

The conditions which must be satisfied to enable avoidance of slippage between a rotating member and an elongated element contacting a surface of the rotating member have long ago been established by mathematical analysis for the cases of rope and pulley and belt and pulley drives. An example of such an analysis can be found in the book "Machine Design; Theory and Practice" by Aaron D. Deutschmann, Walter J. Michels and Charles E. Wilson, published by Macmillan Publishing Co., Inc. at pages 663 and 664. The conclusions of that analysis are summarized herein by reference to FIG. 3 in which the rotating member is illustrated at RM and the elongated element at EE. The tension in the elongated element on one side of the member RM is given by T1 and the tension of the other side of the element by T2. The angle of wrap of the element EE on the member RM is indicated by the angle W. The coefficient of friction between the element EE and the member RM is indicated by the symbol F. At the limit, just before slippage arises between the element EE and the member RM, the basic mathematical analysis gives the following formula relating the quantities indicated above: $T1=T2\ e^{FW}$ (The formula quoted here is taken from the book "Vorlesungen uber Maschinenelemente" von Dipl.-Ing. M. ten Bosch, published by Julius Springer Veriag in Berlin in 1940. The Deutschmann reference indicated above includes additional factors taking centrifugal force into account).

Figure 3:
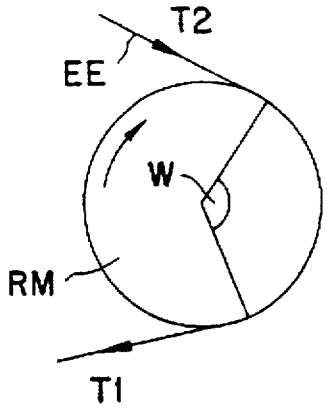
FIG. 3 is a diagram for purposes of illustration of the classical theory of transfer of force from a rotating body to an elongate member contacting the outer surface of the body.
Figure 4:
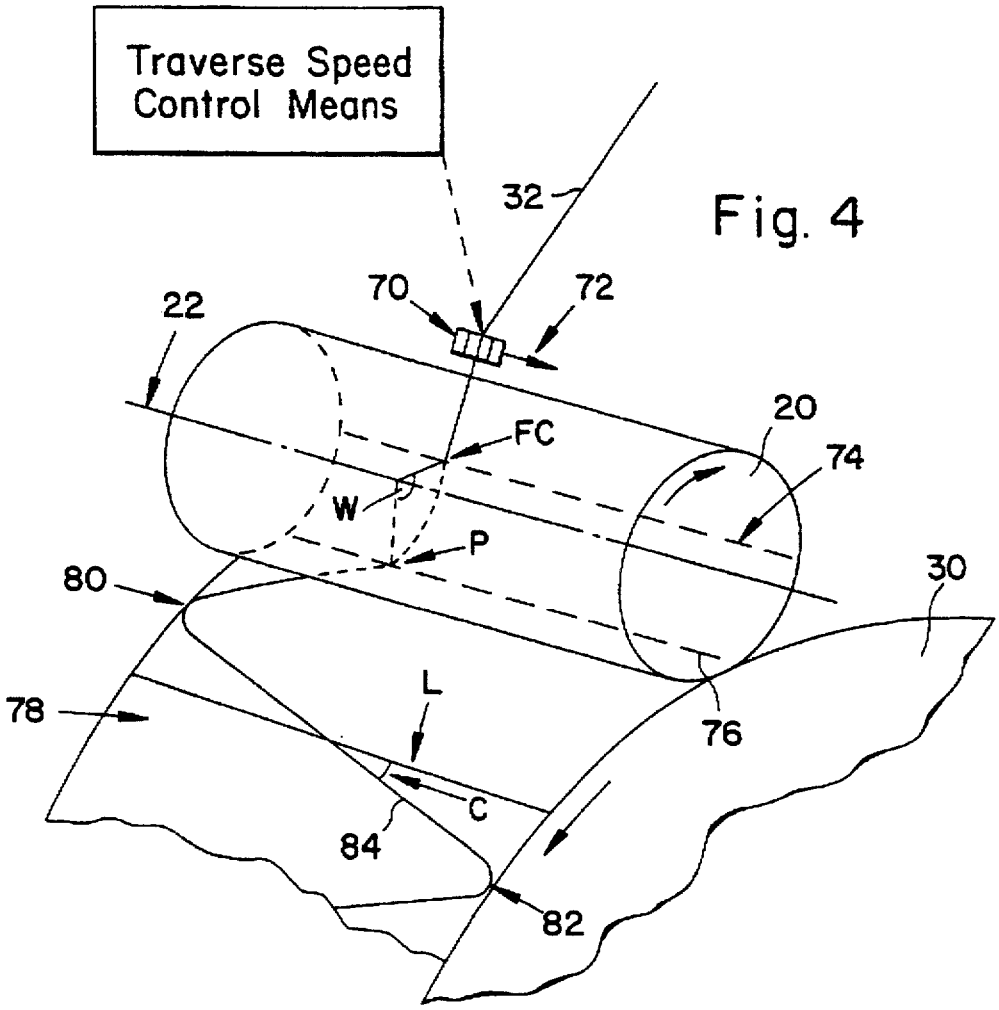
FIG. 4 illustrates schematically the application of the classical theory of FIG. 3 to a system according to this invention.

The classical analysis according to FIG. 3 corresponds in the case of a filament winder arranged according to the assumed operating condition illustrated in the schematic perspective view shown in FIG. 4 in which parts corresponding to the parts shown in FIG. 1 are indicated again by the same reference numerals. Reference numeral 70 indicates the thread guide of the traverse motion 36 (FIG. 1). This guide is assumed to be moving in the direction of the arrow 72 towards the right-hand end of contact roller 20 as viewed in FIG. 4. The line 74 on the surface of roller 20 represents the locus of points at which the thread 32 first contacts the roller 20 as the thread is swept backwards and forwards along the length of that roller by the traverse motion imparted to thread guide 70. The dotted line 76 indicates the corresponding locus of points at which the thread is laid onto the outermost surface of the package 30 giving a laydown pattern on the package surface in the form generally indicated at 78. This laydown pattern includes reversal regions 80, 82 at respective edges of the package joined by straight intermediate sections 84. An angle C is enclosed between each intermediate section 84 and an imaginary line L drawn on the surface of the package and extending parallel to the axis of rotation thereof. This angle C is called the helix angle and is equal to half the so-called cross winding angle which represents an important winding parameter exerting a significant influence upon package structure. The angle C is determined by the speed of traverse of the guide 70 relative to the speed at which thread 32 is delivered to the winder.

The angle of wrap W of the thread on the contact roller 20 is indicated as approximately 90° and is defined by the two radii joining the lines 74, 76 to the axis 16 of the roller 20 in a plane which also contains the point of contact of the thread with the thread guide 70. That is, in the simplified approach, it is assumed that there is no inclination of the thread in the axial direction of the roller 20 between the thread guide 70 and the currently effective point of laydown of the thread on the surface of the package 30. As previously indicated, under such circumstances the mathematical analysis derived for systems as illustrated in FIG. 3 is equally applicable to a system as illustrated in FIG. 4. However, the schematical illustration in FIG. 4 represents a simplification relative to a practical winding operation the circumstances of which are closer to those illustrated schematically in FIG. 5.

In the latter Figure the same reference numerals have been used once again to indicate the same parts. The significant difference relative to FIG. 4 lies in the disposition of the so-called "drag length" DL between the thread guide 70 and the currently effective point of first contact FC with the contact roller 20. This drag length DL is no longer assumed to be contained in a plane normal to the axis 22 of the contact roller (compare FIG. 4). Instead, it is assumed that the drag length encloses the cross winding angle between itself and the tangent TG to the surface of the contact roller 20 at the first contact point FC. Accordingly, the length of the yarn lying in contact with the surface of roller 20 between the point of first contact FC and the point at which the yarn is being transferred to the surface of the package 30 is no longer assumed to lie in the normal plane previously referred to but to follow a helical path SP around the surface of the roller. The previously indicated mathematical relationship between thread tension upstream from the roller 20 and thread tension in the surface layer of the package 30 (assuming avoidance of slippage between the yarn and the surface of the contact roller 20) should therefore be modified to include a term representing the influence of the cross winding angle. The cross winding angle can be increased by reducing the traverse speed of the thread traversing device.

Figure 6:
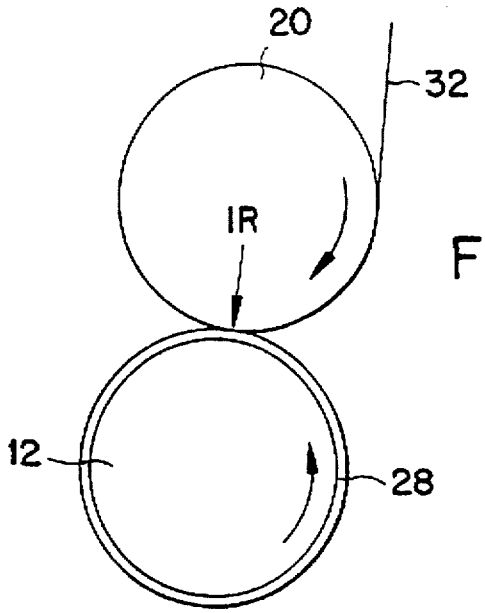
FIGS. 6 and 7 illustrate schematically a single winding operation at various stages thereof.
Figure 7:
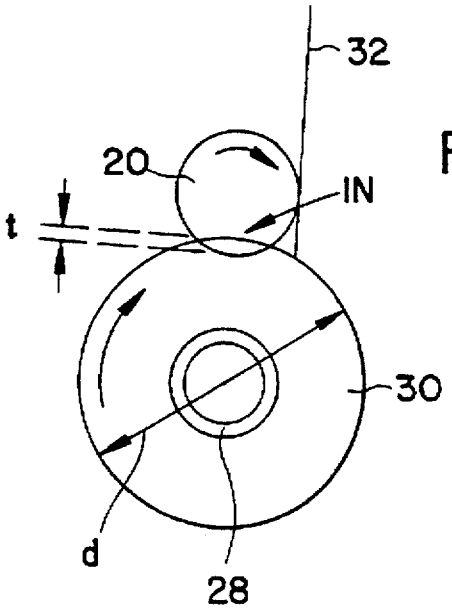

The conditions under which the thread 32 is transported on the surface of the contact roller 20 between the locus 74 and the locus 76 (FIGS. 4 and 5) determine limits for the tension adjustments which can be achieved by means of this invention. They do not, however, determine the actual tension adjustment which will be achieved within those limits. The actual level of adjustment will be determined within those limits by the conditions generated at the interface region between the contact roller 20 and package 30. As now explained by reference to the diagrammatic illustrations in FIGS. 6–8, those interface conditions will inevitably vary in the course of a given winding operation. As will readily be recognized, FIGS. 6 and 7 are drawn to respective different scales. In FIG. 6, the winding operation for a given package is assumed to have just started. The layer of thread forming on the outer surface of bobbin tube 28 is therefore invisible in this Figure. There is practically direct contact between the outer surface of tube 28 (which is supported on its interior by the chuck 12) and the outer surface of roller 20. The material of tube 28 can be assumed to be practically incompressible under these circumstances, and there is virtually line contact at the laydown region IR.

In FIG. 7, the same package is illustrated at a later stage of the winding operation but some time before package diameter d (FIG. 7) has reached the maximum dimension intended. The outer layers of package 30 in FIG. 7 are soft relative to the bobbin tube 28 (FIG. 6) and accordingly the contact roll is now pressed into the package somewhat in the contact region giving an indentation in the interface region.

Figure 7A:
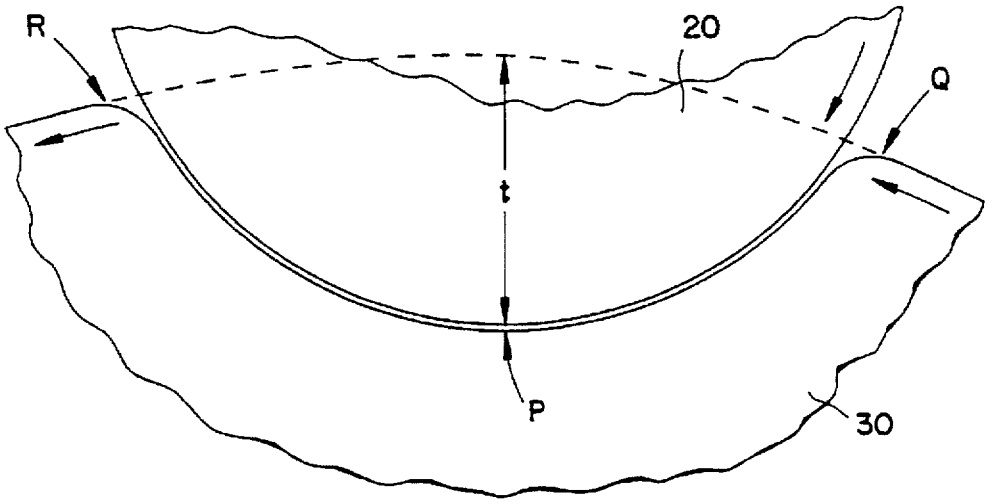
FIG. 7A shows a detail from FIG. 7.

The degree of indentation arising in an individual winding operation depends upon the contact pressure generated at the roller/package interface and the hardness (density) of the package. The presence of this indentation implies that slippage between the surface of the roller and the surface of the package is unavoidable in the region of contact of those surfaces. This will be apparent from examination of FIG. 7A, which represents schematically the interface region of FIG. 7 to a larger scale. The indented surface of the package undergoes a gradual reduction in circumferential speed between the points Q and P, and a corresponding increase in circumferential speed between the points P and R. It is, therefore, impossible to match the surface speed of the roller with the surface speed of the package at all points within the region of indentation.

It is possible with relatively simple means to investigate the relationship between the circumferential speeds of the roller and the package at the point P, where those circumferences intersect the line joining the axis of rotation of the roller to the axis of rotation of the package. In particular, it is possible to measure the revolutions (rpm) of the roller, the revolutions (rpm) of the package and the distance between the two mentioned axes (their separation). Since the radius of the roller is known (and can be assumed invariable under the contact pressure), the distance separating point P from the axis of rotation of the package (i.e., the radius of the package at the point P) can be derived from these measurements.

Based on the above measurements and the data derived therefrom it is possible to calculate the circumferential speed of the roller and of the package at the point P. Investigations have shown that:

a) the circumferential speed of the roller remains substantially constant throughout the winding operation (as expected, under the action of the control system), b) whereas the calculated circumferential speed of the package at the point P lies persistently below the circumferential speed of the roller during operation in the roller advance mode and at the "zero setting".

The calculated speed difference at point P in tests made at delivery speeds (contact roller speeds) between 3500 m/min and 4000 m/min indicate a speed difference at the point P in the range 0.5% to 1.5% under the test conditions (pressing force 60N) for the zero setting and the roller advance mode.

It follows that at the point P the circumferential speed of the package does not rise above the (constant) circumferential speed of the contact roller even as the setting of the drive to the contact roller is reduced so that the package begins to transfer circumferential force to the roller. In fact, test measurements indicate that circumferential speeds of the roller and the package at the point P become equal only when there is a significant degree of transfer of circumferential force from the package to the roller.

Figure 8:
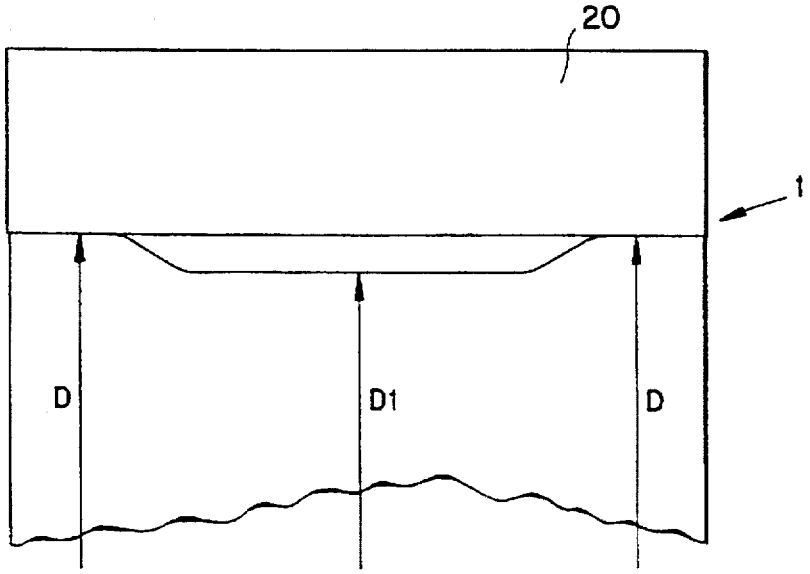
FIG. 8 illustrates schematically the same winding operation at the completion of winding of a package but viewed at right angles to FIGS. 6 and 7.

As seen in FIG. 8, each wall region of the package has the maximum package diameter D, but the central region of the package has a reduced diameter D1 so that the interface region I is now formed only between contact roller 20 and the axially spaced wall regions. The degree of pulling in of the central package region relative to the wall regions has been exaggerated for purposes of illustration in FIG. 8, but the maximum diameter package for given winding conditions will exhibit a small degree of central tightening of this kind. It is in fact the appearance of an unacceptable level of pulling in of the central package region relative to the wall regions which characterizes or defines the maximum possible package diameter. It is the aim of the present invention to enable adaptation of other winding conditions to enable this limit condition to be reached without intermediate thread breakage or breaking off of the winding operation for other reasons.

In view of these changing conditions at the interface region between the roller 20 and the package 30, it is desirable to be able to modify the controlled level of slippage generated in that region in a controlled (preprogrammed) manner in the course of a given winding operation. This can be demonstrated first on the basis of a comparison of the conditions illustrated in FIGS. 6 and 7 with those illustrated in FIG. 8. In the early and intermediate stages of the winding operation (FIGS. 6 and 7) roller 20 is in contact with the package (that expression here is taken to include the tube 28 and/or thread windings thereon) along the full axial length of the traverse motion. The effect of the differential motion of the roller 20 on the surface of the package is therefore substantially uniform over the full axial length of the package. When the package is full, however, the effect of the differential motion appears only in the wall regions which actually engage the contact roller 20. In the central package region where (at least in the schematic illustration according to FIG. 8) there is no longer contact between the roller and the outermost surface of the package, the thread will in any event exhibit a small fall-off in tension because the take-up speed generated by the package region having a smaller diameter D1 is lower than the take-up speed generated by the wall regions exhibiting the full package diameter D.

Accordingly, if the system is arranged to generate a relaxation in the thread between the threadline upstream from the winder and the thread laid on the surface of the package, then the effect of the slippage generated between the roller and the package should be reduced from the beginning to the end of the winding operation to allow for the degree of relaxation of the thread in the central region of the package associated with the effects illustrated schematically (and in an exaggerated form) in FIG. 8. On the other hand, if the effect of the controlled slippage in the interface region is designed to increase thread tension on the surface of the package relative to threadline tension upstream from the winder then this effect should be increased from the beginning to the end of the winding operation to allow for the relaxation in the central region which will arise as explained with reference to FIG. 8.

The description thus far has assumed a cylindrical contact roller 20. This is not an essential feature of the invention. It is known to provide both a "barrel-shaped" contact roller. Both of those roller forms can be used in a machine according to this invention, but the preferred arrangement is one in which a cylindrical roller surface is provided so that the roller exerts a uniform effect on the thread over the full traverse width.

The conditions in the interface region between the contact roller 20 and the package 30 are determined not only by the relative velocities of the mutually contacting surfaces. Those conditions are determined also by the contact pressure exerted between the contact roller 20 and the chuck 12. The fact that contact pressure can exert a significant influence upon level of slippage generated under conditions of rolling contact has been demonstrated by the studies of rolling drive systems previously referred to. The adaptation of the interface conditions to a given winding operation therefore involves the appropriate control of both the mutual velocities of the contacting surfaces and the contact pressure generated between them. Devices for generating contact pressure in filament winders have been known for a considerable length of time and will not be described in detail in this specification. For the sake of completeness, however, an automatic winding machine of the type particularly intended to be operated in accordance with this invention will now be briefly described with reference to FIG. 9. The generation of contact pressure will be briefly indicated in the context of the description of FIG. 9.

Figure 9:
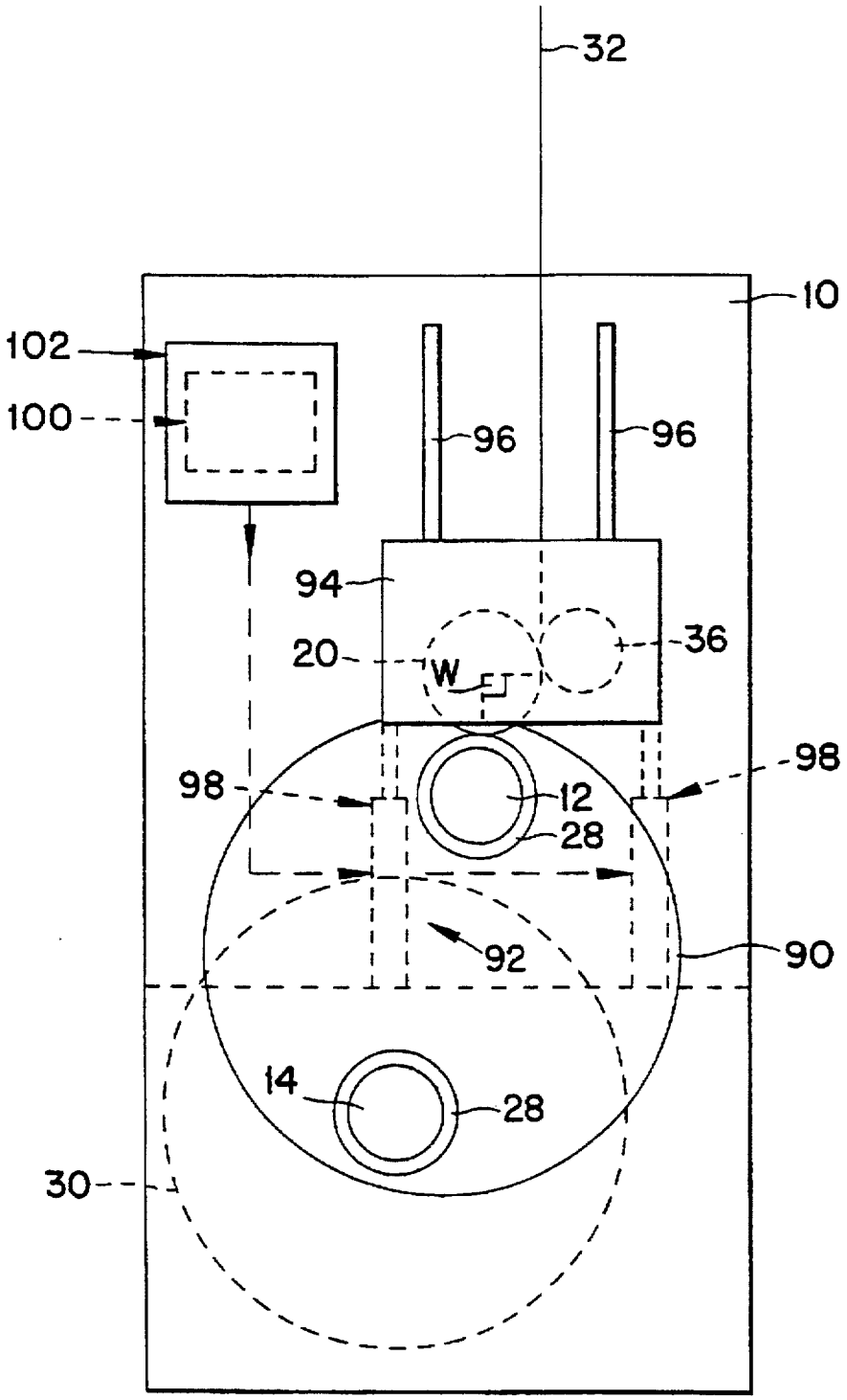
FIG. 9 illustrates schematically the preferred form of winder for use with this invention.

Reference numerals already used in the description of FIG. 1 have been used again to refer to similar elements in FIG. 9. Thus, FIG. 9 shows a frame 10, a contact roller 20, a traverse device 36, and a thread 32 to be wound. The winder shown in FIG. 9 is, however, of the automatic type comprising a revolver 90 carrying a pair of cantilever-mounted chucks 12, 14, each of which carries bobbin tubes 28 in use. In the condition illustrated in FIG. 9, winding has started on the tube(s) of the chuck 12, those tubes being in contact with the contact roller 20. The chuck 14 has recently been moved out of the winding position into a lowermost "stand-by" or doffing position in which full packages 30 on the chuck 14 have been (can be) removed from the chuck. This should happen as soon as possible after the changeover operation has been completed, in order to allow for rapid build-up of a new package forming on the chuck 12 now in the winding position.

The revolver 90 is held stationary during a winding operation, and a contact roller 20 and traverse device 36 must therefore be moved vertically upwards as the diameter of a newly forming package increases. For this purpose, roller 20 and traverse device 36 are carried by a cantilever-mounted carriage 94 which is vertically movable along guides 96.

The pressing force generated by the weight of the carriage 94 together with the elements carried thereby is more than enough to generate the required contact pressure in the interface region between roller 20 and packages building on the chuck in the winding position. Some of the weight of the carriage is therefore relieved by piston and cylinder units schematically illustrated in dotted lines at 98. These piston and cylinder units 98 are controllably operated from a programmable control unit 100 located behind an operating panel 102 in the upper left portion of the machine as illustrated in FIG. 9, which may comprise a model RIEMAT A6-09 winder sold by Rieter Chemical Fiber Systems.

Further details of the arrangement for ensuring smooth changeover of winding from one chuck to another upon rotation of the revolver 90 can be found in U.S. Pat. No. 5,318,232, granted on application Ser. No. 07/907,557 of 2 Jul. 1992 in the names of Peter Busenhart, Ruedi Schneeberger, Beat Schefer and Beat Hörler. A device for controlling generation of contact pressure between the contact roller and a package is shown and described in U.S. Pat. No. 5,033,685. Furthermore, a device enabling mounting of a contact roll in a winder of this type is shown and described in U.S. Pat. No. 5,004,170.

By way of example, the significant data of a machine suitable for operation according to this invention are quoted below:

| | |
|---|---|
| Winding Speed Range | up to 12,000 m/min |
| Package Diameter Range | up to 600 mm |
| Contact Roller Diameter | 50 mm to 200 mm |
| Contact Roller Drive Torque | ±4 NM (i.e., 4 NM drive or braking torque) |
| Range of Pressing Force (generating contact pressure) | 10 N to 50 N per package |
| Range of cross winding angles settable for the cited winding speed range | up to 35° |
| Length of Chuck | 300 m to 2 m |
| Maximum axial length of a package (single package per chuck) | 1M |
| Minimum axial length of a package (eight packages per chuck) | 40 mm |

In a straightforward approach, the relationship described with reference to FIG. 3 can be applied directly to a system of the type shown in FIG. 9. The angle of wrap W of the filament on the contact roller 20 illustrated in FIG. 9 is approximately 90°. This is determined by the geometry of the winder design and cannot be significantly adapted without a major modification in that geometry. The coefficient of friction between the filament and the surface of the roller is radically affected by the spinning conditions (e.g. the cross section of the filament involved, the application of lubricants and possibly other fluids to the threadline upstream from the winder, and to some extent by the surface condition of the contact roller itself). Under practical winding conditions this analysis indicates that it is possible to affect winding tension relative to threadline tension in a system of the kind indicated in FIG. 9 at the most by a factor of approximately 1.7, i.e. the winding tension can be at the most increased by a factor of 1.7 relative to the threadline tension or at the most decreased by a factor of 1.7 relative to the threadline tension. Within this range, winding tension can be controllably determined by choosing the setting of the drive to the contact roller while maintaining a given winding speed determined by the set value for comparison with the feedback signal from the contact roller.

By increasing the setting of the drive to the contact roller (i.e., increasing the setting of device 54 in FIG. 2), the circumferential force applied by the contact roller to the package increases and thereby produces an increase in slip between the contact roller and package to reduce the thread tension at laydown in the package relative to thread tension at the winder inlet. Likewise, by reducing that setting, the thread tension at laydown in the package would be increased relative to thread tension at the winder inlet.

Figure 10:
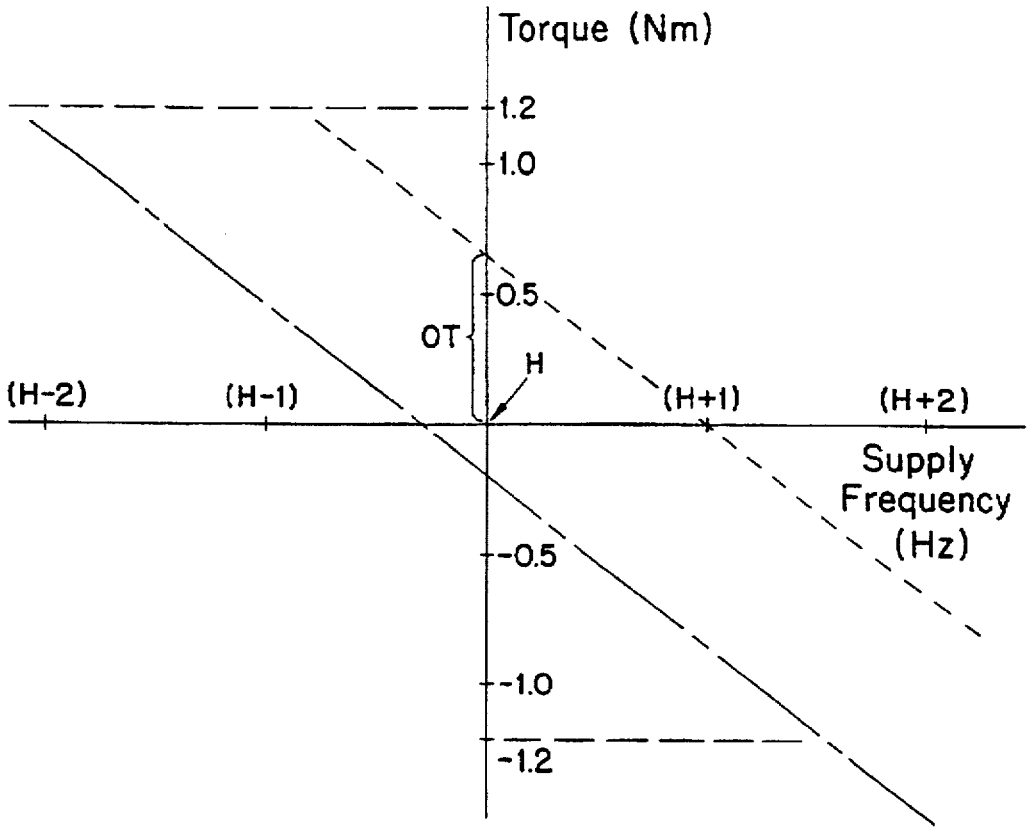
FIG. 10 illustrates the torque/speed characteristic of a drive motor suitable for the contact roller of a winder as shown in FIG. 9, FIG. 11 a schematic perspective view of a winder according to a second aspect of the invention, FIG. 12 a side view of a package illustrating a first evaluation criterium for package build, and FIG. 13 a side view of a package illustrating a second evaluation criterium for package build.

The motor generating an output torque which is applied directly to the contact roller 20 is an asynchronous motor 24 supplied by invertor 46. The characteristic linking output torque and rotor speed for a motor for this type is illustrated in FIG. 10 in which motor torque in Newton-meters is represented on the vertical axis and motor revolutions on the horizontal axis. The dotted line box represents the limits of the physical capabilities of the motor, in particular the maximum torque which can be generated by a motor of this type under load. FIG. 10 can be interpreted as follows:

The vertical (output torque) axis intersects the horizontal (speed) axis at the no load speed of the contact roller drive motor and this no load speed is preferably selected to be equal to the desired delivery speed of the thread (as was explained with reference to FIG. 6 in U.S. Pat. No. 4,548,366).

The fact that the motor characteristic intersects the vertical axis below the intersection of the speed and torque axes indicates that the contact roller drive must be energized to a small extent even under no load conditions so that motor losses, e.g. windage and bearing losses are compensated by the motor energization; accordingly, under the assumed no load conditions, contact roller 20 is rotating at the same circumferential speed as the package surface contacted thereby, and there is no transfer of load between the package and the contact roller (in either direction).

The no load speed of the contact roller motor mentioned above corresponds to a supply frequency just under a given value H (Hz).

If it is desired to transmit force at the interface region, the supply frequency to the contact roller motor must be set to a value other than the no load frequency, e.g. to (H+1) Hz; this causes a shift of the motor characteristic to the right relative to the disposition illustrated in FIG. 10 until the characteristic intersects the "synchronous" speed at the set supply frequency, in the assumed example (H+1) Hz.

The contact roller is, however, actually still operated with a circumferential speed equal to the winding speed as determined by the feedback loop described in U.S. Pat. No. 4,548,366; accordingly, a net transfer of force from the contact roller to the package surface is generated and is represented by the output torque of the contact roller drive motor indicated at OT in FIG. 10.

The output torque generated at the surface of the contact roller can be taken as a direct measure of the circumferential force supplied by the contact roller 20 to the package in contact therewith because the diameter of the contact roller is fixed (in contrast to the diameter of the package which varies throughout the winding operation). This circumferential force is distributed across the axial length of the package surface (or across the total axial length of all packages contacting the roller 20 in the event that a plurality of packages are formed simultaneously on a single chuck in contact with the roller 20).

A simple analysis of the relationships shown in FIG. 10 gives the maximum torque, that can be exerted on a given package. This depends on both the actual torque generated by the contact roll drive and the number of packages built simultaneously on one chuck. For example, if contact roll 20 is generating the maximum of 1.2 Nm according to FIG. 10 and eight packages are being formed simultaneously on the chuck in the winding position, then the torque applied by the contact roll to each package (assuming parallel dispositions of the contact roll and chuck axes) will be 0.15 Nm per package (=1.5 kg cm per package). If only a single package is being formed on the same chuck, the maximum torque that can be applied to the surface of that package by the contact roll is 1.2 Nm. Since the diameter (radius) of the contact roll is constant, the circumferential force corresponding to the generated torque does not change as the package diameter increases.

Figure 5:
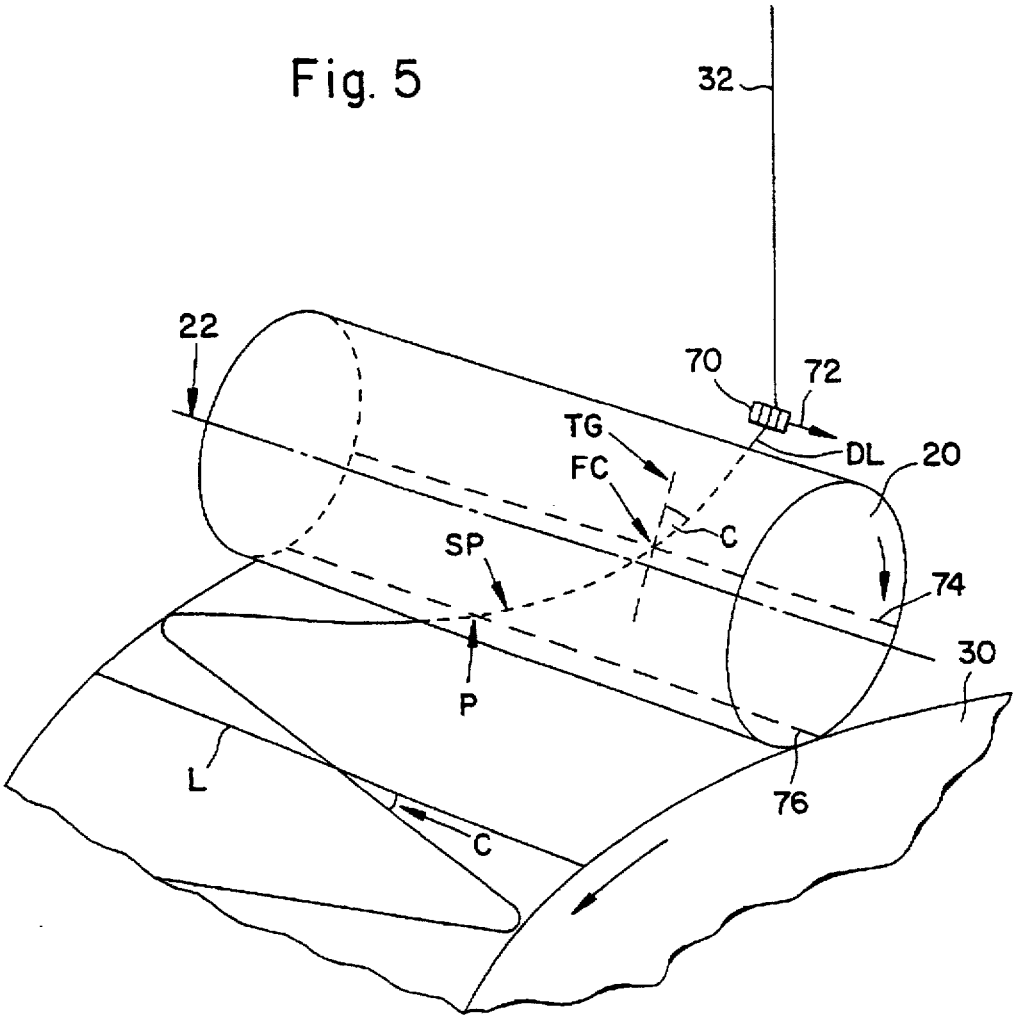
FIG. 5 illustrates schematically a closer approach to the actual conditions in a winder according to the invention.

As clearly seen in FIGS. 4 and 5, however, the filament newly laid onto the surface of a package occupies only a small part of the total surface of contact established between the roller 20 and the package 30. At any given instant, the thread does not "respond" to the total circumferential force exerted by the contact rail, but only to the local effect of that force at the laydown point. Accordingly, it is not the total circumferential force (effective motor torque) applied to a package, that is significant, but rather the circumferential force generated per unit length of contact between the roller and the package. For example, a chuck of length 900 mm can carry eight packages of axial length 85 mm or two packages of axial length 410 mm. The tension effect achieved by applying an effective torque of 1.2 Nm to the eight packages (i.e., 0.15 Nm per package) will be approximately the same as the tension effect achieved by applying an effective torque of approximately 1 Nm (i.e., 0.5 Nm per package) to the two packages (for a given filament and with otherwise unchanged winding conditions). The effect of a given frequency setting for the contact roll will therefore vary slightly over the period of a winding operation because of the gradual change in effective "contact length" between a given package and the contact roller for the reasons explained with reference to FIG. 8. This represents a further reason for modifying the tension adjusting settings in a pre-programmed manner throughout the period of a given winding operation. There will also be slight differences in performance of the system depending upon whether only a single package is being formed (so that the circumferential force generated in accordance with the given speed setting is distributed more or less uniformly along the whole length of that one package) or a plurality of packages are being formed (in which case the same circumferential force associated with the given speed setting is distributed over an effectively reduced contact length because of the gap or gaps between adjacent packages on the chuck).

Yarn Quality

Reference has previously been made to the fact that this invention does have some influence on yarn quality even though an improvement of yarn quality is not the primary goal of the proposals now put forward. In this connection it must be recognized that the major factor causing degradation of yarn quality over the period of a winding operation is contact pressure applied especially on limited surface areas such as those in the wall regions in FIG. 8. The present invention serves to improve average yarn quality by further delaying the appearance of the saddle formation which is the direct course of the quality degradation referred to above. This degradation is particularly unacceptable (when it goes outside prescribed limits) because there is a variation in degradation over the width of the package so that the yarn taken from the package for subsequent processing does not exhibit uniform characteristics from beginning to end of the package.

IN OPERATION, a first test package of a given thread is wound in the usual manner, with the rotary speed of the contact roller 20 being kept constant to produce a constant draw tension on the thread approaching the interface between the contact roller and the package. After the package has been built to at least a predetermined minimum diameter, e.g., 400 mm, the winding is stopped and the package is inspected for its surface appearance to determine whether, during the winding of the next test package, the apparatus should be operated in the "package advance" mode or "roller advance" mode, as described earlier herein. If humps have formed on the package surface, it is likely that the thread tension at the package inlet was too low, dictating that during the next winding operation, the apparatus would be operated in the "package advance" mode.

By this means, the tension at laydown is increased relative to thread tension at the inlet to the winder. The setting of the contact roll is thereby adjusted so that the package transfers drive force to the roller (acting in a braking mode) either until the humps disappear or until the limit of the permissible tension adjustment (see the discussion of FIGS. 3 to 5) is reached. In the latter case, the thread cannot be wound under the given conditions and some adjustments must be made upstream from the winder.

It is assumed here that the possible settings for the contact roller drive are adjustable over a range such that the maximum possible tension adjustment (as determined by slip on the contact roller) is achievable by adjusting the drive roller setting alone, i.e., without additionally altering further winding parameters such as the contact pressure. The contact pressure itself can then be set independently in the light of other winding conditions, as will appear from the following discussion of faults which can be treated by means other than an increase in tension between the winder inlet and the laydown point.

"Humps" are formed on the otherwise cylindrical surface of the package if thread tension in the outer layers of the package is too low, so that "loose" layers are being wound. In this case, there is a clear remedy (as described above), namely, an increase in winding tension. The defects to be discussed below arise from interactions of various factors, so that a change in winding tension serves as one of a plurality of measures which can be taken to deal with the problem.

The following description refers to winding of a series of packages, with evaluation of each package in the series enabling adjustment of winding parameters before winding of the next package in the series. It will be understood that the "package" referred to in each case may be one of a "group" of packages formed simultaneously (in one winding operation, on a single chuck). The results derived from the "package" referred to in the following description stand for the results of a given winding operation in a series of such operations.

Figure 12:
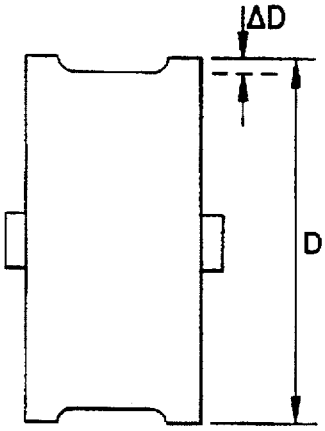
Figure 13:
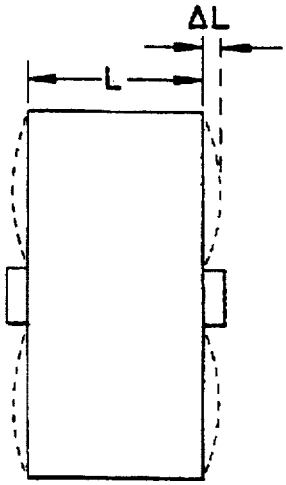

Assuming that no humps have formed in the package surface (i.e., the winding tension is at least adequate to wind the desired package), the operator visually inspects the package to determine whether there are any other deviations therein from a cylindrical shape, for example a saddle shape (FIG. 12) or side wall bulging (FIG. 13). It is known according to the prior art, to deal with such deviations by changing the cross winding angle and/or the contact pressure. The present invention adds another adjustment feature which can be exploited together with the previously known possibilities to deal with the problems found under the given winding conditions.

If unacceptable deviations are found, the operator can employ the steps outlined in Table I below:

TABLE I

| Roller Advance Mode | |
|---|---|
| Deviation | Adjustment Steps |
| Bulging of Side Walls | (i) Increase cross winding angle |
| | (ii) Decrease thread tension by increasing contact roll drive setting |
| | (iii) Decrease contact pressure |
| Saddle Formation | (i') Decrease thread tension by increasing contact roll drive |
| | (ii') Decrease cross winding angle |
| | (iii') Increase contact pressure |

It will be appreciated from Table I that the two parameters "Cross Winding Angle" and "Contact Pressure" are limited in their effectiveness for dealing with a given deviation or defect, because the adjustment of these winding parameters in a particular sense (to solve one of the two problems) is liable to induce the other problem. Only a decrease in thread tension at the laydown point has a beneficial effect on both defects. The range within which thread tension at this point can be adjusted is, however, limited by the requirement that slip of the thread on the contact roll should be avoided (see FIGS. 3 to 5 and the corresponding description).

Changes in cross winding angle and contact pressure may in any event have to be associated with offsetting changes in the setting of the contact roll drive in order to give optimum package build. This is relatively easily appreciated in relation to contact pressure, which affects directly the friction and therefore the degree of slip appearing at the interface for a given level of circumferential force generated by the contact roll motor. Thus, if contact pressure has to be increased (in an attempt to "squash" the walls of a saddle formation), this will increase the friction force at the interface and decrease the slip level at the interface for a given setting of a contact roll motor. This will decrease the thread tension effect previously obtained at the given setting. A subsequent increase in the contact roll drive setting may therefore give a better result than that obtainable by retaining the setting used before the change in contact pressure.

An example of a procedure for dealing with side wall bulging arising in a given winding operation is given below:

- in a first step, the cross winding angle is increased following which a second package is wound and inspected;
- if the bulging has not been eliminated the cross winding angle may be increased again, if other facts (for example, the intended use of the package in downstream processing) do not speak against such a further change. If no further change in cross winding angle is permissible/desirable, the operator proceeds to step (ii) by increasing the setting of the device 54 of the contact roller for reducing the thread tension at laydown in the package relative to threadline tension at the winder inlet. Whichever step is taken, a third test package is formed and evaluated (visually inspected);
- if sidewall bulging is still unacceptable in the third package, the operator can try a further decrease in winding tension or he can proceed to the third step (change of contact pressure). A fourth test package is then formed and visually inspected;
- if the fourth package still displays unacceptable bulging, then further adjustments can be tried in the winding parameters quoted. If the limits of these changes have been reached and bulging remains, the "given winding conditions" must be changed.

The sequence of steps (i), (ii), and (iii) as listed in Table I represents the preferred or initially recommended order for making adjustments. However, the actual case must be evaluated by the operator in dependence upon his knowledge of the surrounding circumstances. The procedure involved in dealing with saddle formation is analogous to that described for sidewall bulging. The preferred order of adjustments is, however, different as indicated by the sequence (i'), (ii'), (iii') in Table I.

The foregoing procedures do not require that the winding parameters be held constant during the winding of a given test package. Rather, a parameter, e.g., contact pressure, could be changed during the winding of the package, e.g., when a predetermined package diameter(s) is reached. That is, the optimum winding parameters for the winding of a particular type of thread could involve a changing of one (or more) of the winding parameters during the winding of a given test package.

In this mode of operation, a "pattern" is established for each winding parameter (or at least, for the variable winding parameter). The parameter in question is then varied in accordance with this predetermined pattern from the start to the end of the winding operation. Each of the three previously mentioned winding parameters can be varied in this way according to a preset pattern, that is the cross winding angle, the contact pressure and the winding tension (relative to the tension at the winder inlet). The pattern could involve a continuous change in the parameter as winding proceeds. Preferably, however, the pattern involves a stepwise change in the pattern as is already used (for example) in the winding of so-called step precision wound packages.

One reason for changing the thread tension at laydown in the package over the period of package build has been explained with reference to FIG. 8. In practice, depending on the winding conditions, it may be necessary to vary the setting of the contact roll drive over the period of package build in order to obtain a constant tension adjustment influence. The gradual change in package diameter may lead to a change in influence of the indentation (FIG. 7A) caused by the contact roller even if the contact roller setting and the contact pressure are held constant. The effect cannot be predicted because it depends also upon possible changes in package density as the package grows. By means of empirical evaluation, programmed variability can be adapted to compensate the physical effects in a given case, to provide, for example, a constant tension adjustment effect.

The pattern is preferably defined as a function of package diameter, because this parameter is commonly measured in the currently available winders. This is not, however, essential. The pattern could be defined, for example, as a function of time since the time required to wind a given package will be either calculable or readily determinable empirically.

Once the optimum settings for the winding parameters have been determined for minimizing the rate of bulging and saddle formation, all subsequent commercial winding operations for that particular thread would be performed at such optimum settings.

It will be appreciated that the above procedures will reduce the rate of formation of the particular deviation from cylindrical shape so that packages can be formed which are of larger diameter than would otherwise be possible under the given winding conditions.

In the foregoing, a procedure has been explained which relies upon the visual inspection of packages by an operator. It would also be possible to perform such inspections automatically as will hereinafter be discussed. The method of automatically regulating the performance of a thread winding machine, could be employed particularly but not exclusively, with a filament winder of the kind shown in FIG. 1 or in FIG. 9. According to this aspect of the invention, the thread winding machine is provided with a control device adapted to adjust predetermined winding parameters in dependence upon an evaluation of a package produced by the machine in a winding operation. The machine may additionally comprise an evaluation means for evaluating a package produced during a winding operation and for providing a corresponding signal or group of signals to the the control means. However, it is not essential to provide the package evaluating means in an individual winder. Packages from a group of winders could be provided to a common evaluation station from which the evaluation signal or signals are transmitted to the respective winders. In this case, however, it is necessary to arrange for coordination of the products of the individual winding machines with the signals produced in the evaluation station so that the latter signals can be returned to the appropriate winders.

In the preferred arrangement, therefore, each winding machine is provided with its own evaluation means which is preferably adapted to respond to the condition of a completed package. In an arrangement of this kind, no attempt is made to change winding parameters in response to evaluating of a package carried out in the course of an individual winding operation, but those parameters can be adapted before a new operation is started in response to the results of the preceding winding operation. In a winder arranged for automatic changeover from one operation to the next, e.g. of the kind shown in FIG. 9, the evaluation means can be provided, e.g. in the region of the doffing or stand-by position to respond to the package condition as soon as full packages arrive in that position. The resulting signals can be supplied to the machine control to adept winding parameters before the next winding operation is started.

Consistent with the description of the first aspect of this invention, the evaluation means is preferably adapted to evaluate package condition on the basis of package build (package structure). In particular, it is possible to evaluate on the one hand saddle formation (of the kind described with reference to FIG. 8) and on the other hand bulging of the axial end walls of the package. An evaluation means for this purpose can be based upon known optical image analysis techniques.

Figure 11:
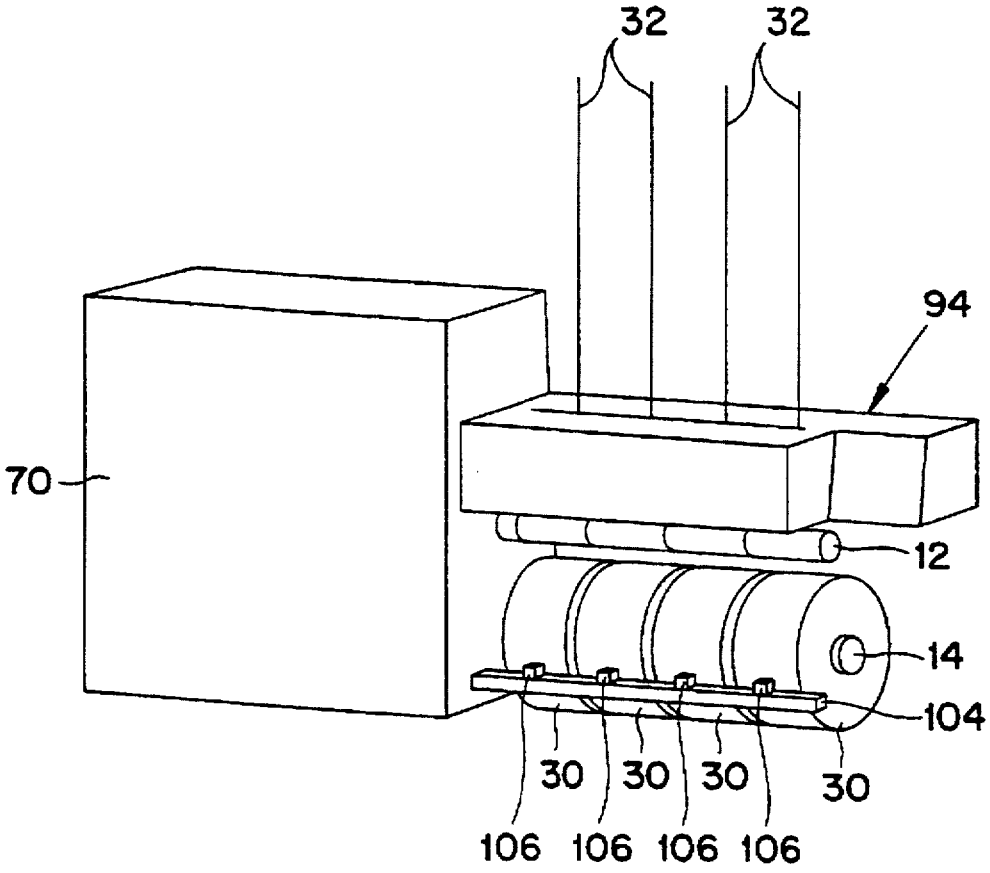

By way of example, an embodiment of this second aspect of the invention will now be described with reference to FIGS. 11, 12 and 13. FIG. 11 shows a perspective view of a winder essentially similar to that shown in FIG. 9, the same reference numerals being used to indicate the same parts. Accordingly, the winder in FIG. 11 includes a frame 10, a vertically reciprocable carriage 94 and a pair of chucks 12, 14 mounted on a revolver. The latter has not been illustrated in FIG. 11, because it is not essential to the features now to be described and will in any event be readily apparent from the illustration in FIG. 9 itself.

The winder shown in FIG. 11 is additionally provided with an elongated hollow carrier element 104 extending from the frame 10 parallel to a chuck (in FIG. 11, the chuck 14) in the doffing position. Carrier 104 carries four package structure evaluating devices 106 corresponding respectively with the four packages produced in this case during each winding operation. Each evaluating device 106 is connected by leads (not shown) extending along the interior of the carrier element 104 into the frame 10 for connection to the control unit 100 (FIG. 9).

Each evaluating means 106 is adapted to evaluate two criteria of package build or package structure as illustrated in FIGS. 12 and 13, respectively. Each of FIGS. 12 and 13 illustrates in full lines a "perfect" package 30 of a predetermined maximum diameter D and axial length L. In the event of saddle formation, there will be a determinable departure from perfect form as illustrated in FIG. 12 (and as previously described with reference to FIG. 8). This means that the diameter of the central portion of the package will be smaller by an amount $\Delta D$ relative to the perfect package form. In the case of a package defect in the form of bulging of the axial (side) walls of the package, the effective axial length of the package at an intermediate point between the carrier tube 28 and the outer cylindrical surface of the package will be greater by an amount $\Delta L$ than the predetermined length L.

By means of known optical imaging techniques it is possible to determine both the degree of saddle formation, e.g. defined as $\Delta D/D\text{-}100\%$) and the degree of bulging (e.g. defined as $\Delta L/L\text{-}100\%$) and to provide a corresponding signal to the control unit 100.

The package defects illustrated in FIGS. 12 and 13 are essentially determined by three winding parameters, namely:

pressing force (generating contact pressure), cross winding angle, thread tension at the point of laydown in the package.

All of these three winding parameters are under the control of the control unit 100. The cross winding angle can be controlled, for example, by controlling the speed of axial traverse of the thread guide 70 (FIGS. 4 and 5) for a given delivery speed of the thread 32. The thread tension at the point of lay-down in the package can be controlled by the contact pressure, and the setting of the drive to the contact roller, described with reference to FIGS. 1 to 10.

The control unit 100 is programmed with control functions, e.g. in the form:

$\Delta D=F1$ (C, CP, TT), and $\Delta L=F2$ (C, CP,TT) where the terms F1 and F2 represent functional relationships, C is the cross winding angle (see FIGS. 4 and 5), CP is contact pressure and TT is the thread tension.

The control unit 100 can be adapted to store the actual values of $\Delta D$ and $\Delta L$ obtained from a series of winding operations and to analyze such series of values for tendencies (or the absence of such tendencies). The winder can then be made self-regulating (self-optimizing) so that the three winding parameters are adjusted to minimize, as far as possible, the values of $\Delta D$ and $\Delta L$ obtained for further winding operations.

The machine would preferably be designed to change the settings of winding parameters between the winding of the first and second test packages, if the evaluation of the first package indicates package building problems. Thereafter, the machine would automatically inspect and evaluate a series of winding operations to detect trends in the deviation formation, the changing of winding parameters being performed manually.

Another package defect which can be automatically detected is so-called "overthrown ends" which occurs when the thread goes beyond the end of the package and extends across the side wall of the package. This can be corrected by changing the cross winding angle. Sensors for detecting an overthrow end are disclosed in German Documents DE-36 30 668, DE-37 18 616, and DE-42 11 985, the disclosures of which are incorporated by reference.

Although the invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A method of winding into a package a thread supplied by a threadline upstream of a winder of the type in which a thread to be wound has a substantial angle of wrap around the circumference of a motor driven contact roller in substantially rolling contact with the outer surface of a motor driven filament thread package and in which said contact roller can apply a rotationally driving or restraining force to the package surface while the speed of rotation of the roller is regulated by regulating the speed of rotation of the package, said method comprising winding thread passing from the outer surface of the contact roller into a cylindrical thread package, and changing the torque output of a motor driving said contact roller while said contact roller is in substantially rolling contact with said package surface and while said roller is rotating at a constant speed to maintain a constant threadline tension upstream from the winder, said change being sufficient to exert lengthwise force on the thread to change the tension in the portion of the thread delivered from the outer surface of said contact roller into said package surface.

2. A method according to claim 1, wherein the torque output of said motor driving said contact roller is changed while a package is being wound.

3. A method according to claim 2, wherein said change in the torque output of the motor driving said contact roller is in a direction to reduce the tension in the thread portion entering said package.

4. A method according to claim 2, wherein said change in the torque output of the motor driving said contact roller is in a direction to increase the tension in the thread portion entering said package.

5. A method according to claim 1, wherein said change in the torque output of the motor driving said contact roller is insufficient to cause slippage between the thread and the surface of the contact roller upstream from the roller/package interface.

6. The method as in claim 1, further comprising winding the thread passing from the outer surface of the contact roller onto the thread package at a predetermined winding angle and varying the winding angle to adjust package structure.

7. A method of controlling a winder in a filament spinning and packaging system for establishing a threadline tension level adapted to the filament processing conditions upstream of the winder and a different winding tension level suitable for the production of acceptable thread packages, said winder being of the type in which a thread to be wound has a substantial angle of wrap around the circumference of a contact roller in substantially rolling contact with the outer surface of a filament thread package and in which said thread package is rotated by a first motor controlled by a control system having a first setting device for setting the circumferential speed of said thread package and in which said contact roller is driven by a second motor controlled by a second setting device for causing said contact roller to apply a rotationally driving or restraining force to the package surface while the speed of rotation of the roller is regulated by regulating the speed of rotation of the package, said method comprising selecting a setting for said first setting device to cause said contact roller to remove thread from said threadline at a rate to maintain a selected threadline tension level; and selecting a setting for said second setting device to cause said contact roller to exert lengthwise force on the thread to set a different winding tension level in the portion of the thread delivered from the outer surface of said contact roller into said package surface.

8. A method according to claim 7, wherein said winding tension level is lower than said threadline tension level.

9. A method according to claim 8, wherein the winder includes settable pressing means for pressing together said contact roller and said package, and wherein said method comprises selecting a setting for said pressing means to provide a pressing force high enough to prevent uncontrollable circumferential sliding of said contact roller with respect to the surface of said package.

10. A method according to claim 7, wherein said winding tension level is higher than said threadline tension level.

11. The method as in claim 7, wherein the thread is delivered from the outer surface of the contact roller onto the package at a predetermined winding angle, said method further comprising varying the winding angle to adjust package structure.

12. A method for winding a filament package in a winding arrangement wherein a thread is laid onto a building package with a contact roll in engagement with an outer surface of the package, said method comprising:

laying the thread onto an outer surface of a building package at a predetermined winding angle by conveying the thread with a given upstream threadline tension at a predetermined wrap angle around a circumferential portion of the contact roll, the contact roll in surface rotational engagement with the package;

rotationally driving the package with a controllable first drive device at a desired rotational speed to achieve a desired thread wind-up rate;

generating a control signal corresponding to the rotational speed of the contact roll and using the control signal as representative of circumferential speed of the package to control the first drive device and rotational speed of the package in order to maintain desired thread wind-up rate;

with the contact roll, generating and applying a circumferential force to the package to induce a controlled amount of slippage within a predetermined range between the contact roll and package, the slippage causing thread tension at a point of laydown on the package to vary from upstream threadline tension; and determining a change in thread tension at point of laydown on the package necessary to correct an undesired package shape and varying the circumferential force applied by the contact roll to the package so as to induce a change in slippage between the contact roll and package to produce the necessary change in thread tension.

13. The method as in claim 12, further comprising rotationally driving the contact roll with a controllable second drive device.

14. The method as in claim 13, wherein said step of generating and applying the circumferential force with the contact roll comprises driving the contact roll at a rotational speed to apply a circumferential braking or advancing force to the package.

15. The method as in claim 12, wherein said contact roll has a variable pressing force against the package outer surface, said step of generating and applying the circumferential force with the contact roll comprises varying the degree of pressing force.

16. The method as in claim 12, further comprising applying a braking circumferential force to the package with the contact roller to increase thread tension at point of laydown on the package.

17. The method as in claim 12, further comprising applying an advancing circumferential force to the package with the contact roller to decrease thread tension at point of laydown on the package.

18. The method as in claim 12, further comprising varying the circumferential force applied by the contact roll as the package forms during winding so as to variably change thread tension at point of laydown on the package to account for changing package parameters or shape.

19. The method as in claim 18, comprising reducing thread tension at point of laydown on the package as the package forms.

20. The method as in claim 12, wherein said step of determining a change in thread tension comprises empirically determining the necessary change in thread tension to correct the package shape in a pre-operational winding evaluation process.

21. The method as in claim 20, wherein said evaluation process comprises incrementally varying thread tension by varying the circumferential force applied to the package by the contact roll in winding of a plurality of test packages and determining optimal changes in thread tension and corresponding changes in circumferential force to correct for various package shape defects.

22. The method as in claim 21, further comprising empirically determining the optimal changes in thread tension for various sets of different winding parameters.

23. The method as in claim 12, further comprising varying the winding angle of the thread on the package to adjust package structure.

* * * * *